US009854866B2

(12) United States Patent
Berthier et al.

(10) Patent No.: US 9,854,866 B2
(45) Date of Patent: Jan. 2, 2018

(54) PROTECTIVE HELMET WITH MOVEABLE CHIN GUARD WITH AUTOMATIC SHIELD LIFTING MECHANISM

(71) Applicant: SHARK, Marseilles (FR)

(72) Inventors: Philippe Berthier, Marseilles (FR); Jean Francois Maillard, Marseilles (FR); Moise Arribard, Auriol (FR)

(73) Assignee: SHARK, Marseilles (FR)

( * ) Notice: Subject to any disclaimer, the term of this patent is extended or adjusted under 35 U.S.C. 154(b) by 343 days.

(21) Appl. No.: 14/803,504

(22) Filed: Jul. 20, 2015

(65) Prior Publication Data

US 2016/0015114 A1 Jan. 21, 2016

(30) Foreign Application Priority Data

Jul. 21, 2014 (FR) ..... 14 57005

(51) Int. Cl.
*A42B 3/22* (2006.01)
*A42B 3/32* (2006.01)

(52) U.S. Cl.
CPC ..... *A42B 3/326* (2013.01); *A42B 3/222* (2013.01)

(58) Field of Classification Search
CPC ..... A42B 3/22; A42B 3/221; A42B 3/222; A42B 3/223; A42B 3/224; A42B 3/225; A42B 3/226; A42B 3/227; A42B 3/228; A42B 3/18; A42B 3/185; A42B 3/20; A42B 3/205; A42B 3/326
USPC ..... 2/424, 6.3, 6.4, 6.5, 6.7
See application file for complete search history.

(56) References Cited

U.S. PATENT DOCUMENTS 4,794,652 A * 1/1989 Piech von Planta .. A42B 3/326 2/12
6,598,238 B2 * 7/2003 Hong ..... A42B 3/326 2/424
8,082,600 B2 * 12/2011 Morin ..... A42B 3/222 2/15

(Continued)

FOREIGN PATENT DOCUMENTS

EP 1101419 A1 5/2001
FR 2886521 A1 12/2006

(Continued)

*Primary Examiner* — Khoa Huynh
*Assistant Examiner* — Griffin Hall
(74) *Attorney, Agent, or Firm* — Cantor Colburn LLP

(57) ABSTRACT

A protective helmet including a shell on which are moveably mounted a shield and a chin guard, the chin guard being moveable between a closed position and an open position and having two lateral branches each provided with a guide in which is meshed a guiding finger fixed on the shell, and the shield being moveable between a lowered position and a lifted position and having two lateral arms articulated on the shell, the helmet having an automatic lifting mechanism of the shield configured to lift the shield from the lowered position during the closing movement of the chin guard and including at least a cam-follower system including: a rotary cam secured to a guiding finger pivotally mounted on the shell and connected in rotation to the corresponding lateral branch of the chin guard by cooperation of form with the guide, and a follower element secured to a lateral arm of the shield, wherein the cam and the follower element are at least in partial contact along a given cam surface.

10 Claims, 8 Drawing Sheets

(56) References Cited

U.S. PATENT DOCUMENTS

2011/0302701 A1* 12/2011 Kuo ..... A42B 3/326
2/421

FOREIGN PATENT DOCUMENTS

IT EP 3001919 A1 * 4/2016 ..... A42B 3/223
WO 2006045912 A1 5/2006

* cited by examiner

PROTECTIVE HELMET WITH MOVEABLE CHIN GUARD WITH AUTOMATIC SHIELD LIFTING MECHANISM

CROSS REFERENCE TO RELATED APPLICATION

This application is related to and claims the benefit of French Patent Application Number 14/57005 filed on 21 Jul. 2014, the contents of which are herein incorporated by reference in their entirety.

TECHNICAL FIELD

The present invention relates to a protective helmet, in particular for a motorcyclist.

It more particularly relates to a protective helmet of type including a shell on which are moveably mounted a shield and a chin guard.

BACKGROUND

Such helmets are known to offer a dual configuration, namely:

an "integral" configuration in which the chin guard is closed at the front of the helmet and provides protection for the facial portion of the chin, and a "jet" configuration in which the chin guard is open and placed on the back of the helmet, beyond the top of the shell, in order to clear the face of the wearer while keeping the helmet in place on the skull, while preventing having a protruding chin guard in open position for, on the one hand, preventing severe injuries of the neck of the wearer in the event of a fall and locking by friction against the ground or other obstacles and, on the other hand, to optimize the aerodynamic feature of the helmet in the open position of the chin guard.

It is thus known from document EP 1 806 986 to design a protective helmet in which the chin guard has two lateral branches each provided with a guide in which is meshed at least one guiding finger fixed on the shell, in such a manner that the chin guard slides along these guiding fingers between the open and closed positions, and the shield has two lateral arms articulated on the shell.

In order to guarantee the sealing of the helmet in <<integral>> configuration, this document EP 1 806 986 proposes that the shield when lowered, bears against an upper outer edge of the closed chin guard, and the chin guard collaborates with guiding means shaped for guiding the latter along a not entirely circular trajectory which, combining rotation and translation, along which the chin guard moves away from the shell and tips towards the back by passing over the shield to its open position.

This particularly advantageous solution however has a drawback, namely that when the chin guard is in open position and the shield is in lowered position, the wearer must manually lift the shield in order to allow the chin guard to return to the closed position.

This manual lifting of the shield, prior to closing the chin guard, has a drawback in terms of safety. In fact, if the wearer wishes to bring his/her chin guard towards the front in closed position, while driving, he/she must carry out two movements, namely lift the shield then tip the chin guard towards the front, thus contributing in increasing the handling time and reducing vigilance during the time of the operation.

BRIEF SUMMARY

The purpose of the present invention is to resolve this issue by proposing a helmet equipped with at least an automatic lifting mechanism of the shield when the chin guard is displaced from the open position to the closed position.

To this end, it proposes a protective helmet, in particular for a motorcyclist, of the type including a shell on which are moveably mounted a shield and a chin guard, the chin guard being moveable between a closed position at the front of the shell and an open position in which the chin guard is positioned at the back of the shell beyond the top of the shell, the chin guard having two lateral branches each provided with a guide in which is meshed at least one guiding finger fixed securely on the shell, in such a manner that the chin guard slides along these guiding fingers between its two positions, and the shield being moveable between a lowered position and a lifted position and having two lateral arms articulated on the shell, wherein the helmet comprises an automatic lifting mechanism of the shield configured to lift at least partially the shield from its lowered position during the closing movement of the chin guard passing from its open position to its closed position, the lifting mechanism of the shield including at least a cam-follower system comprising:

a rotary cam secured to a guiding finger, said guiding finger being pivotally mounted on the shell along a transversal rotational axis and being connected in rotation to the corresponding lateral branch of the chin guard by cooperation of form with the guide thereof, and a follower element secured to a lateral arm of the shield, wherein the cam and the follower element are at least in partial contact along a given cam surface.

Thus, thanks to this lifting mechanism with cam-follower system(s), the tipping of the chin guard towards the front, starting from the open position, causes in a concomitant manner the lifting of the shield, initially lowered, by making the most of the or each guiding finger which guides the chin guard in its movement for turning one or two rotary cams which act on one or two respective follower elements to lift the shield.

In this manner the closing operation of the chin guard, by bringing the latter from back to front, is carried out in one single operation without prior manual handling of the shield, with the advantage to save safety and vigilance time for the helmet wearer.

It is to be considered to have only one single cam-follower system, which will be located on the right or on the left of the shell, or to have two cam-follower systems, which will be located on the right and on the left of the shell.

According to a feature, the or each cam-follower system is configured in such a manner that, when starting from a configuration in which the chin guard is in open position and the shield is in lowered position, when the cam pivots as a result of the closing movement of the chin guard, said cam comes in contact with the follower element and drives the displacement of the shield by acting on the follower element in the direction of an at least partial lifting of the shield.

In the aforementioned configuration, the cam and the follower element may be in contact, in such a manner that the lifting of the shield begins as soon as the chin guard starts to be tipped towards the front.

In a variant, in this configuration, the cam is spaced apart from the follower element with a predefined mounting clearance, and comes in contact with the follower element only after the chin guard has travelled over a certain part of the return path towards the closed position. Thus, the lifting of the shield does not start straight away when the chin guard leaves its open position.

According to another feature, the or each cam-follower system is configured in such a manner that, when starting from the first configuration, when the cam pivots as a result of the closing movement of the chin guard, the cam drives the displacement of the shield by acting on the follower element in the direction of a lifting of the shield to a partially lifted intermediate position, and then the cam and the follower element break contact once the shield is in said intermediate position whereas the cam continues to pivot until the chin guard reaches its closed position.

Thus, the or each cam-follower system causes a partial lifting of the shield as a result of the closing movement of the chin guard, in order to allow some degrees of freedom required for the smooth operating of the lifting mechanism of the chin guard. In fact, by making sure that the cam or each cam breaks contact with its follower element before the shield is in lifted position (hence locked in totally lifted position), a potential locking situation is prevented.

In a particular embodiment, the lifting mechanism further includes at least a return element urging the shield from the intermediate position to the lifted position.

Thus, the return element or return elements, preferably of elastic return element type, take over from the cam-follower system or systems in order to lift the shield, once the cam or each cam has broken contact with the follower element thereof and has left the shield in its partially lifted intermediate position.

Advantageously, each lateral arm of the shield supports, at a free end, an articulation axis slidably mounted in an oblong orifice provided on a wall secured to the shell.

Thus, this oblong orifice allow a displacement of the shield from front to back, or from back to front, thereby allowing a complex movement of the shield, combining translation and rotation, advantageous for the concomitant kinematics of the shield and the chin guard, and in particular for bringing the shield close to the shell when it is lifted in order to facilitate the passage of the chin guard over the shield.

In a particular embodiment, each lateral arm of the shield supports a pin meshed in an arched groove mounted on the shell in order to impose a not entirely circular trajectory to the shield between its lowered and lifted positions.

These arched grooves allow guiding the shield in the aforementioned complex movement, while ensuring a sufficient mechanical hold of the shield on the shell.

In an advantageous manner, the arched grooves are shaped in order to impose a trajectory combining translation and rotation in which during the lifting of the shield, starting from the lowered position, the shield first moves away from the shell towards the front, then follows a rotation movement, and finally draws closer to the shell to the lifted position.

This complex trajectory is of course allowed thanks to the aforementioned oblong orifices.

According to a possibility of the invention, each lateral branch of the chin guard supports, on an inner face, at least one guiding pin meshed in a slot formed on a lateral wall secured to the shell, said slot defining a trajectory of the chin guard which is not entirely circular, combining rotation and translation, between its open and closed positions.

These slots, in which the respective guiding pins slide, ensure the guiding of the chin guard along the aforementioned not entirely circular trajectory, which allows the chin guard, starting from the closed position, to space apart from the shell (in other words move away to the front, either according to a movement of pure translation or according to a movement combining translation and rotation), then to tip towards the back of the shell by passing over the shield, and reaching the back of the shell (beyond the top of the shell) in order to be in closed position. It is advantageous that, at the end of this opening movement of the chin guard, the chin guard gets close to the back of the shell in order to reach its final closed position.

According to another possibility of the invention, at least one guiding pin is in abutment against a corresponding guiding finger when the chin guard is in closed position.

Thus, at least one guiding finger, which possibly supports a cam, serves as a retainer for the corresponding guiding pin.

In accordance to another advantageous feature of the invention, each groove has a starting portion which defines mainly a translation movement towards the front of the chin guard during its opening by starting from the closed position, in such a manner that the guiding pin is spaced away from the front guiding finger before said guiding finger starts pivoting with the chin guard or before it has pivoted by a few degrees.

Thus, during the opening of the chin guard, the rotation of the guiding finger does not hinder the start of the guiding pin, by starting from the closed position of the chin guard.

The present invention also relates to the feature according to which at least a guiding finger includes an outer portion of oblong form substantially complementary with the guide in which said guiding finger is meshed.

This oblong portion espouses the inside of the guide and thereby causes the rotation of the guiding finger when this guide rotates (in other words when the chin guard rotates).

According to a possibility of the invention, the cam or each cam has a protruding lug radially spacing away from the transversal rotational axis of the corresponding guiding finger; this protruding lug defining at least in part the cam surface driving the displacement of the follower element, and hence the displacement of the shield.

According to another possibility of the invention, when the shield is in lowered position and the chin guard in closed position, the shield bears against an upper outer edge of the chin guard, with in particular an inner face of the shield bearing against a seal member held by the upper outer edge of the chin guard.

Thus, the sealing is optimal by being equivalent to that of a standard integral helmet with stationary chin guard.

BRIEF DESCRIPTION OF THE DRAWINGS

Other features and advantages of the present invention will become apparent upon reading the following detailed description, of a non limiting implementation embodiment, made with reference to the accompanying figures in which:

FIGS. 5 to 12 are schematic views partially illustrating the helmet of FIGS. 1 and 2 in different successive configurations, each figure having a first reduced scale view illustrating in a complete manner the shield and the chin guard and a second enlarged scale view (or zoomed) illustrating an automatic lifting mechanism in the different configurations, with:

Figure 1:
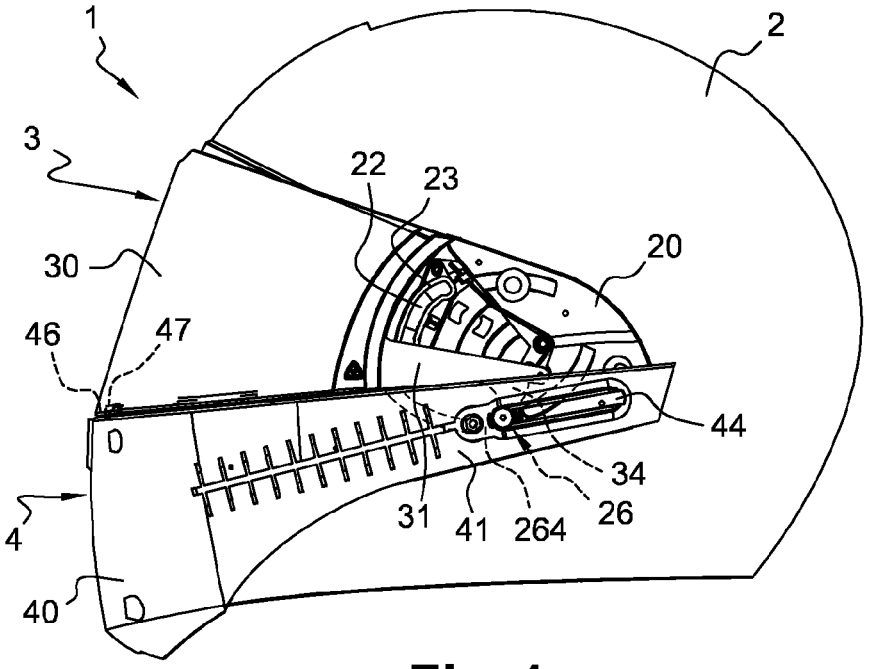
FIGS. 1 and 2 are schematic side views of a helmet in accordance with the invention, with elements which are absent and others transparent for viewing a cam-follower system, in a configuration (FIG. 1) in which the chin guard is in closed position and the shield is in lowered position and in another configuration (FIG. 2) in which the chin guard is in open position and the shield is in lowered position.
Figure 2:
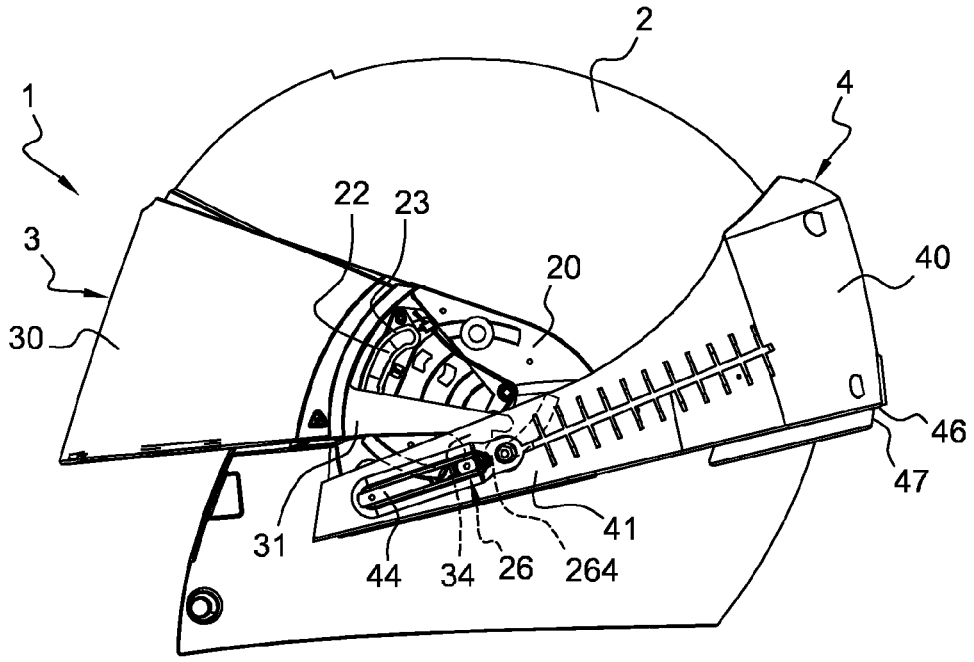
Figure 3:
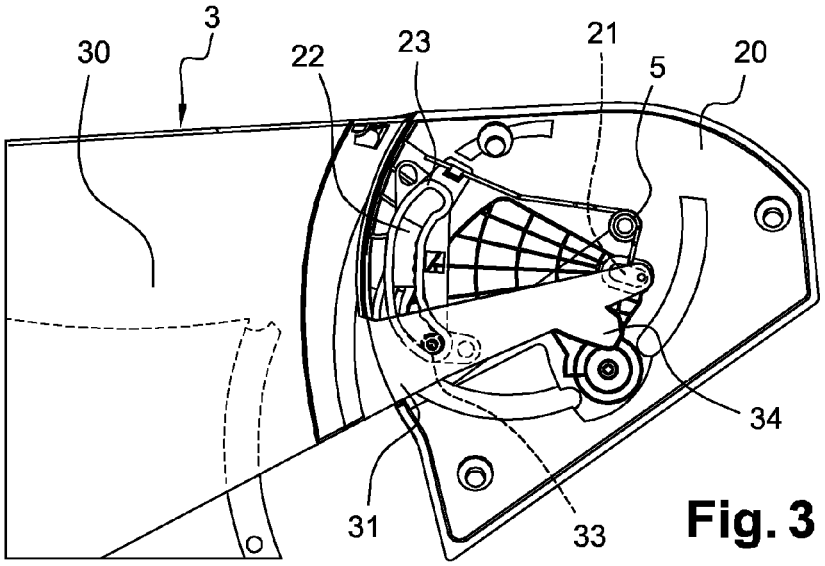
FIG. 3 is a schematic perspective view of a part of the helmet of FIGS. 1 and 2, illustrating the articulation of the shield on the shell.
Figure 5:
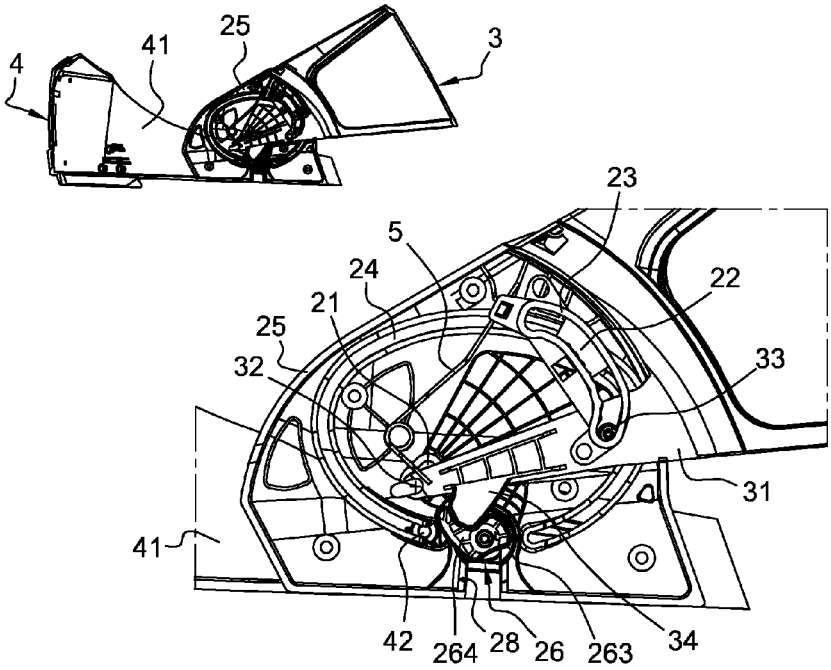
Figure 6:
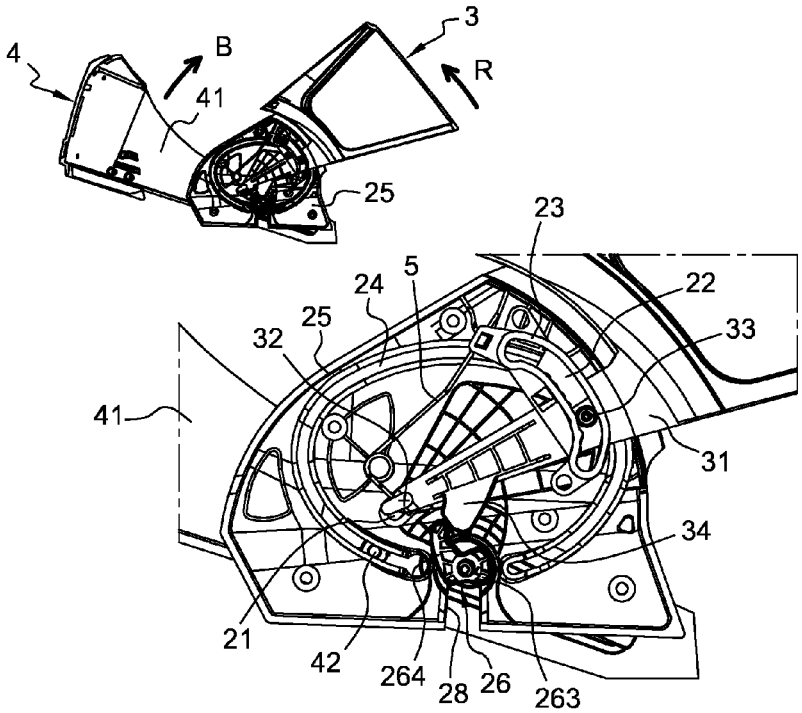
Figure 7:
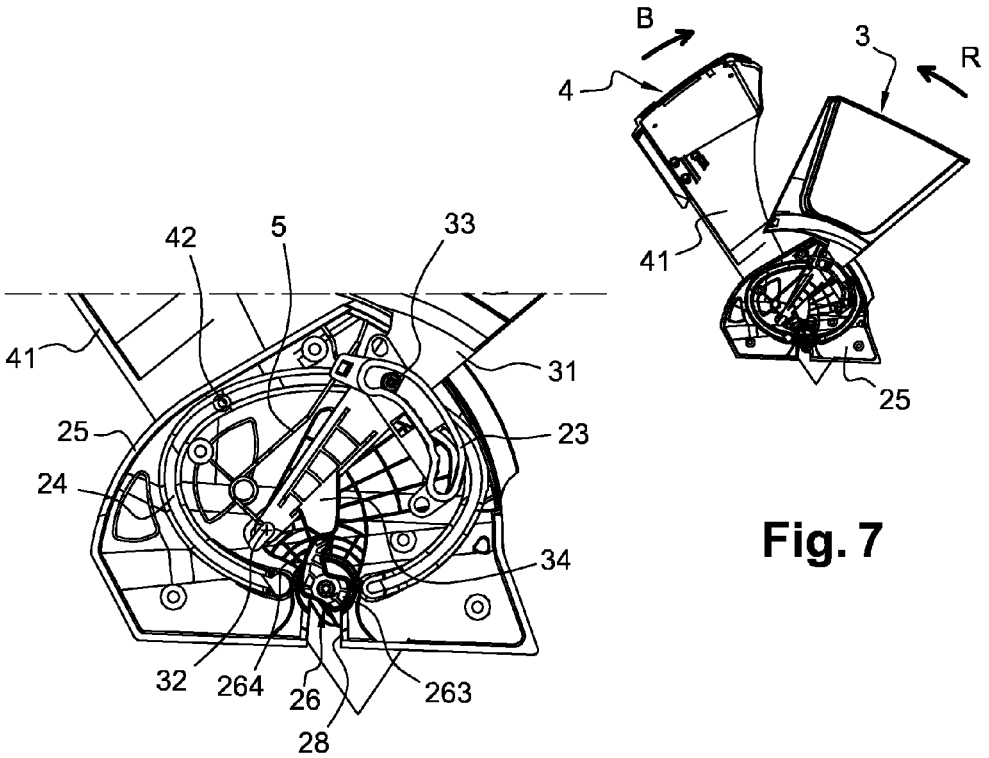
Figure 8:
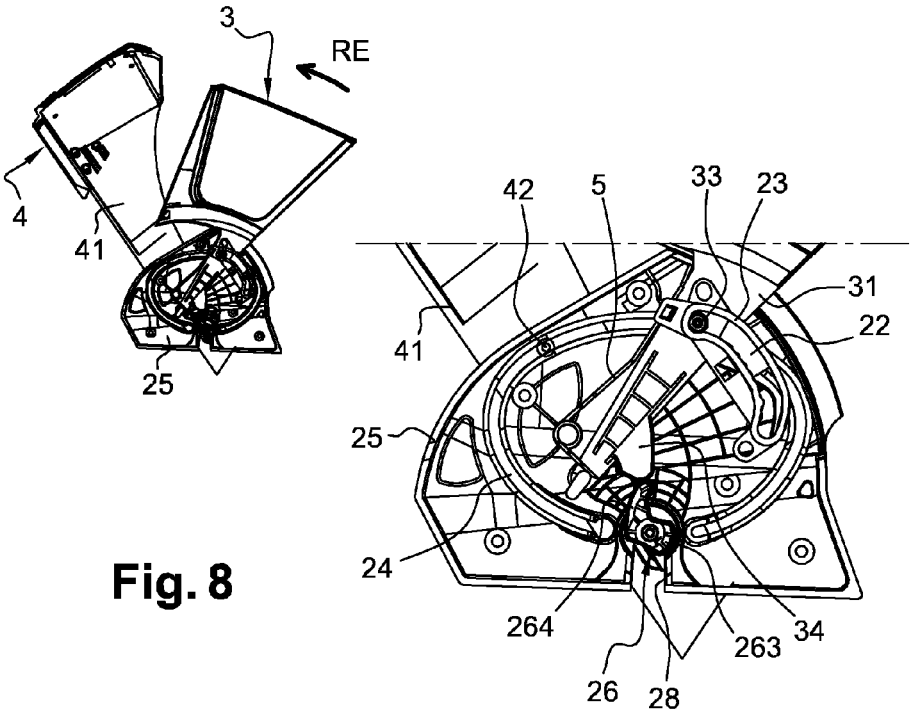
Figure 9:
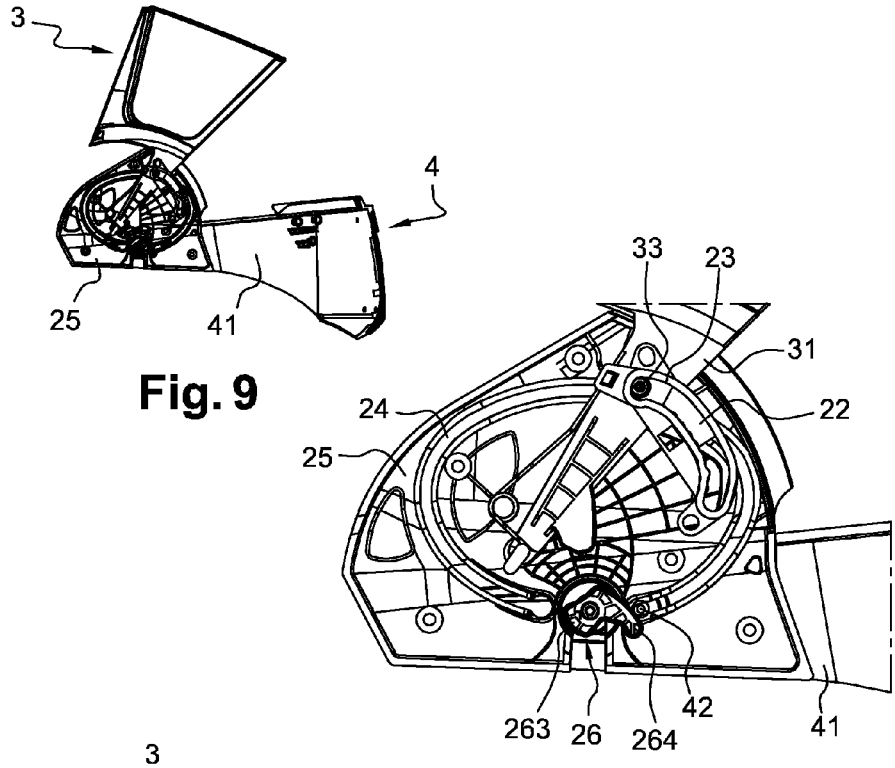
Figure 10:
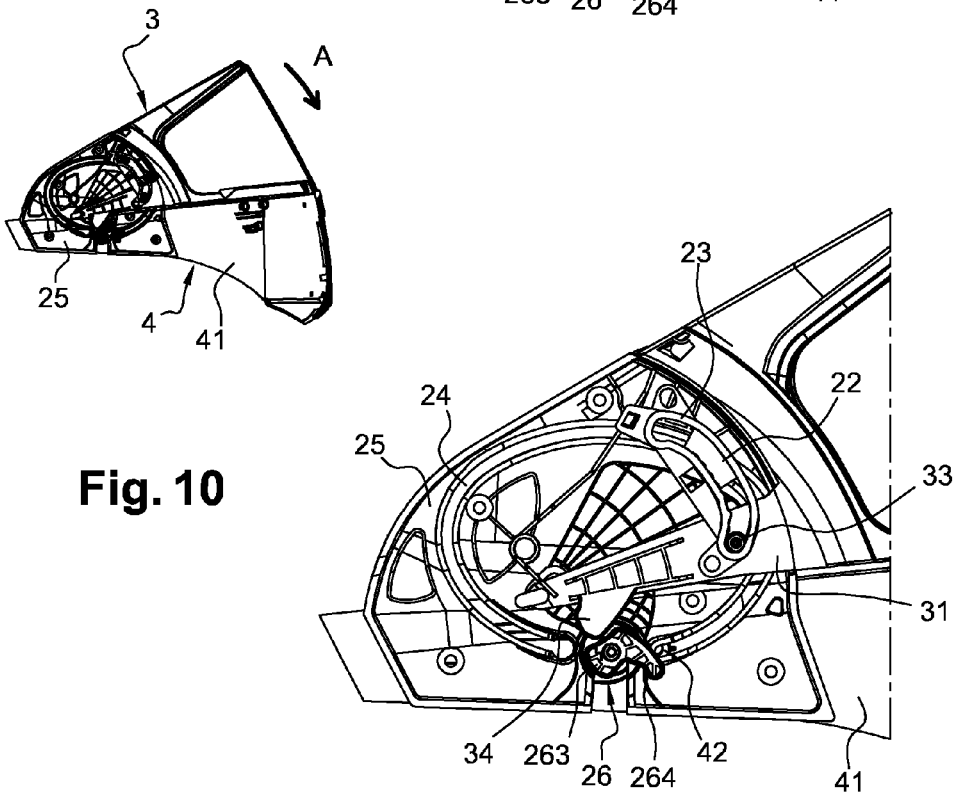
Figure 11:
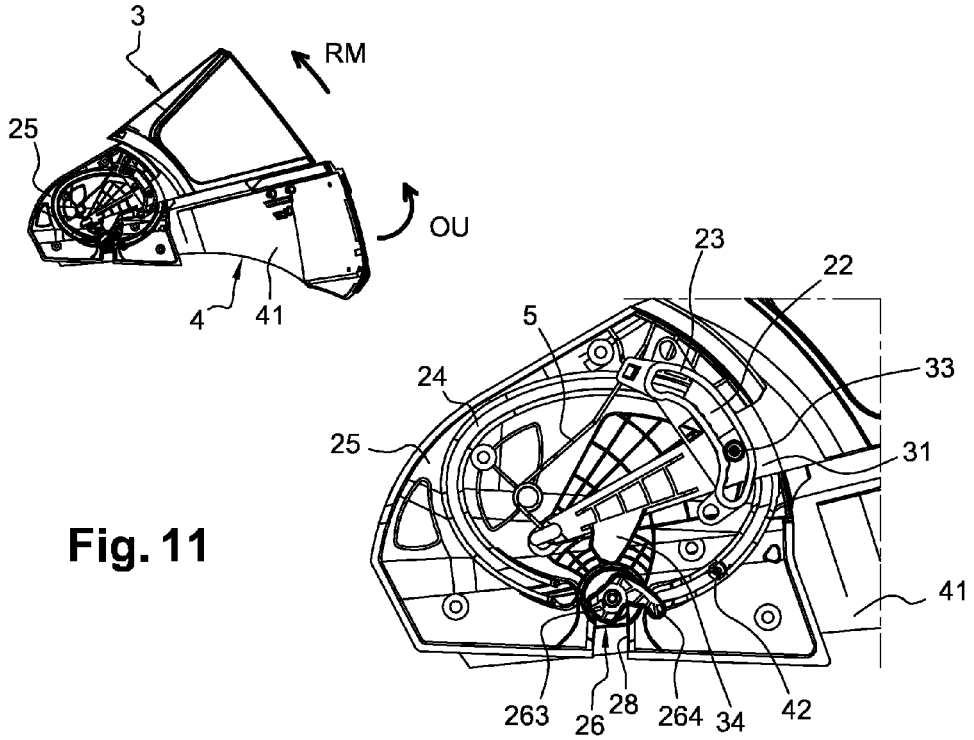
Figure 12:
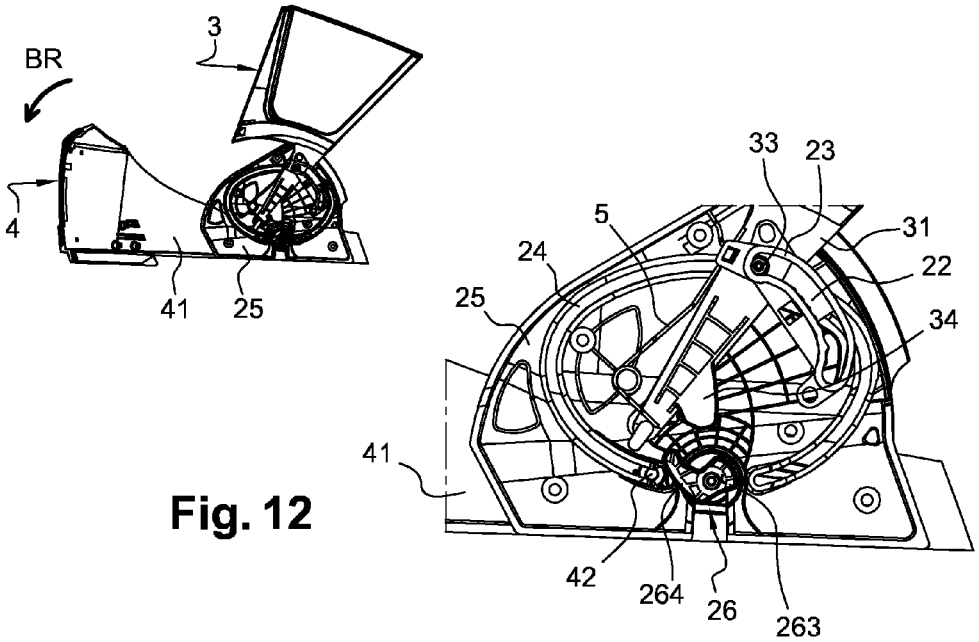
Figure 13:
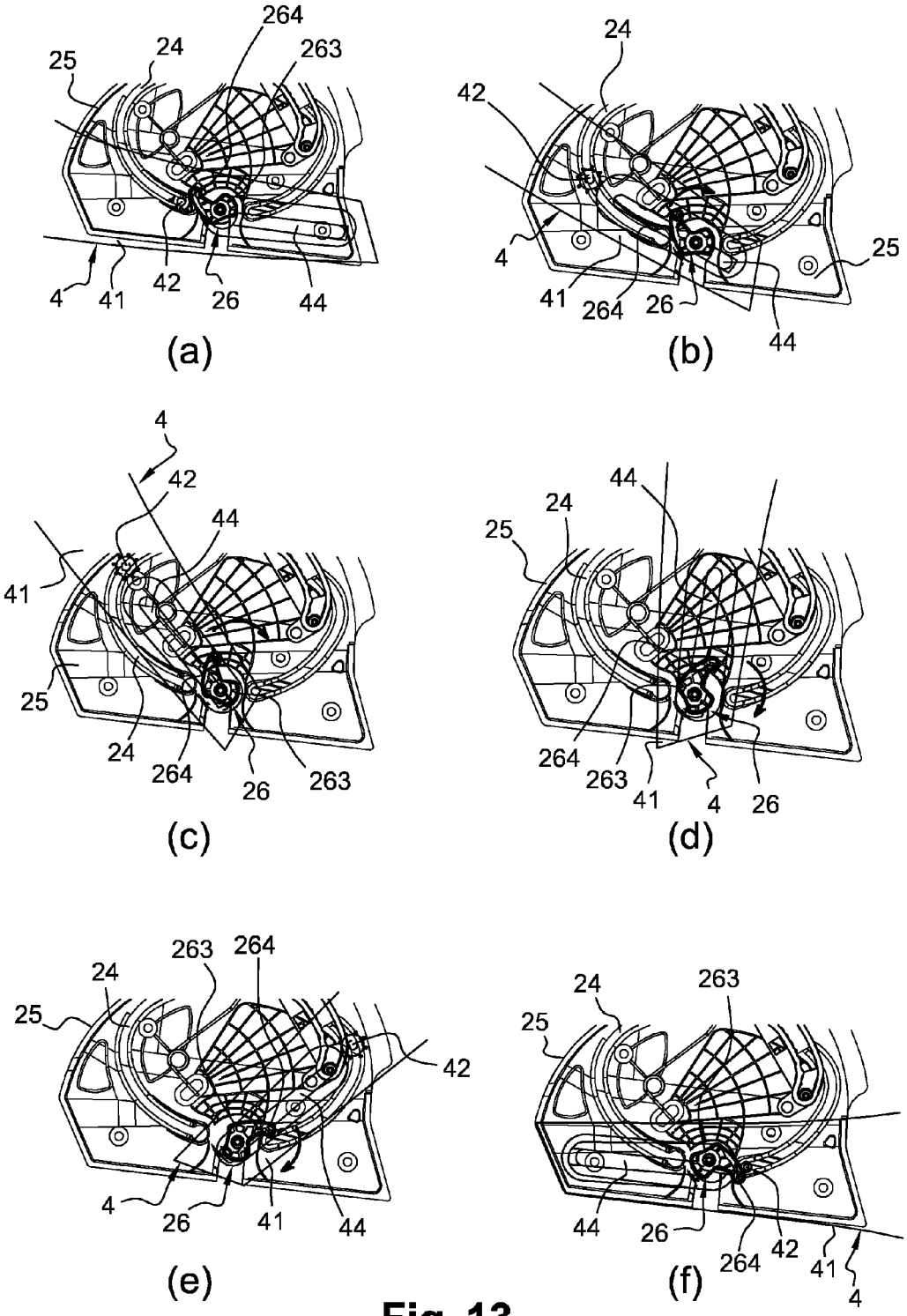
Figure 14:
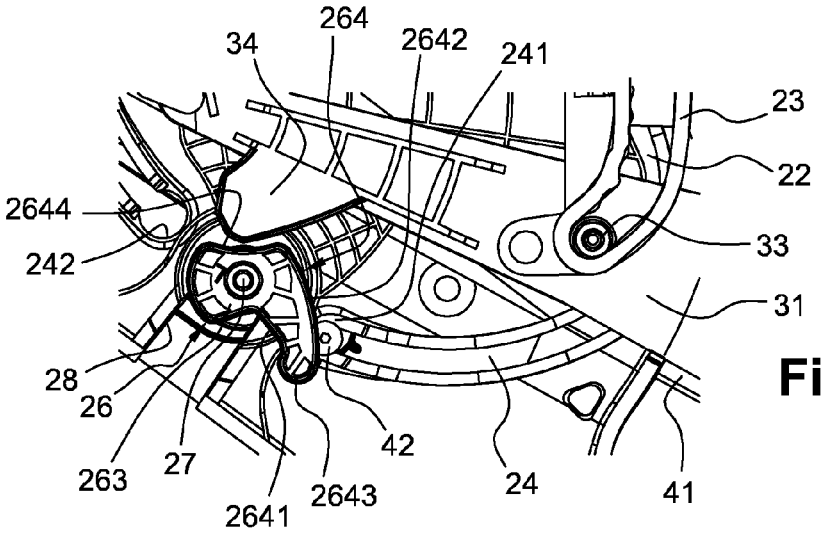
Figure 15:
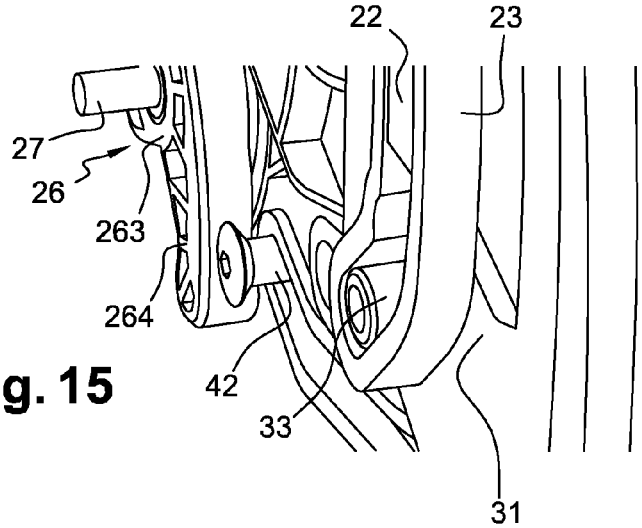
Figure 16:
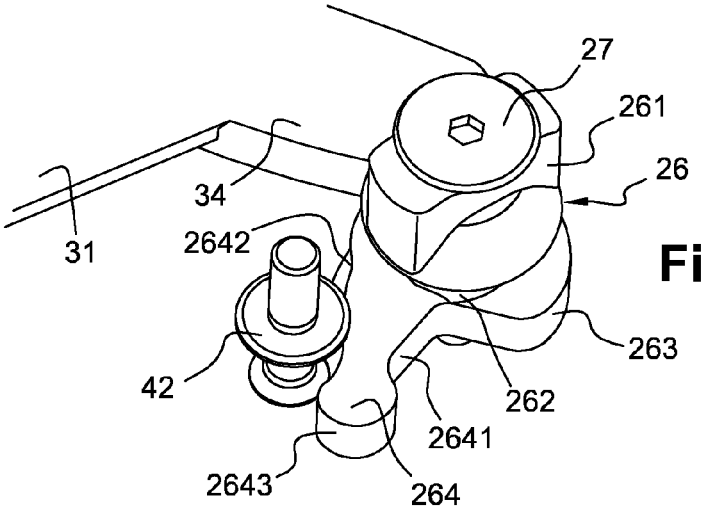

on FIG. 5, a first configuration in which the chin guard is in open position and the shield is in lowered position;

on FIG. 6, a configuration in which the chin guard has started to tip towards the front and has started to lift the shield thanks to the cam-follower systems;

on FIG. 7, a configuration in which the chin guard has continued to tip towards the front and the shield has reached the partially lifted intermediate position thanks to the cam-follower systems;

on FIG. 8, a configuration in which the chin guard has not moved whereas the shield has reached its lifted position thanks to the elastic return elements;

on FIG. 9, a configuration in which the chin guard has finished tipping towards the front and has reached its closed position, whereas the shield has remained in its lifted position;

on FIG. 10, a configuration in which the chin guard has remained in its closed position, whereas the shield has been lowered to its lowered position;

on FIG. 11, a configuration in which the chin guard has been lifted and spaced towards the front with respect to the shell, and the shield has been in part lifted;

on FIG. 12, a configuration in which the chin guard has been tipped towards the back and has reached its open position, and the shield has been lifted and has reached its lifted position;

FIG. 13 has several schematic views partially illustrating the guiding mechanism of the chin guard which rotationally drives the cams for the helmet of FIGS. 1 and 2, during the closing of the chin guard by starting from an open position (figure (a)) to an open position (figure (f)), and with four successive intermediate positions (figures (c), (d) and (e));

FIGS. 14 to 16 are perspective schematic views of details of FIGS. 1 and 2, essentially illustrating a guiding finger and its cam in the closed position of the chin guard.

DETAILED DESCRIPTION

In reference to the figures, a helmet 1 in accordance with the invention includes a stiff shell 2 in a general form of an open spherical bowl, intended to be worn on the head of a wearer and protect the latter. The helmet 1 includes a shield 3 and a chin guard 4 moveably mounted on the shell 2.

The shield 3 is moveable between two extreme positions, namely:

a so-called lowered position (visible on FIGS. 1, 2, 3, 5 and 10) in which the shield 3 is in its lowest position and is positioned facing the face, and particularly facing the nose and eyes of the wearer;

a so-called lifted position (visible on FIGS. 8, 9 and 12) in which the shield 3 is in its lowest position and is positioned facing the front part of the shell 2 which covers the front of the wearer.

The shield 3 has a central visor 30 of curved form, produced in a transparent material and secured to two lateral arms 31 articulated on the shell 2, and particularly on the right and left lateral walls of the shell 2. In a particular embodiment, the lateral arms 31 are articulated on flanges 20 fixed securely on the shell 2.

Each lateral arm 31 has a free end, opposite to the central visor 30, which securely supports an articulation axis 32. This articulation axis 32 is in the form of a cylindrical stem and protrudes towards the inside of the shell 2. This articulation axis 32 ends with a widened head 320 which forms an abutment stop for the articulation axis 32.

The articulation axis 32 of each lateral arm 31 is slidably mounted inside an oblong orifice 21 arranged in a through manner in the corresponding flange 20. The widened head 320 transversally locks the articulation axis 32 inside the oblong orifice 21. The oblong orifice 21 extends in a rectilinear manner substantially from front to back, and has a front bottom located nearer to the front of the helmet 1 and a back bottom located nearer to the back of the helmet 1.

Each lateral arm 31 also supports in a secured manner a pin 33 protruding towards the inside of the shell 2 and disposed at a predefined distance from the articulation axis 32, in the vicinity of the central visor 30.

The pin 33 of each lateral arm 31 is meshed in an arched groove 22 arranged on a guiding piece 23 secured to the shell 2, and more specifically securely fixed on the flange 20.

The lateral arm 31, the articulation axis 32 and the pin 33 may be produced in one single piece, such as in the example illustrated on the figures, or in several elements fixed together. The guiding piece 23 is a piece which is distinct from the flange 20 and is fixed on the latter, in particular by screwing or riveting, in the example illustrated on the figures, and in a variant the guiding piece 23 and the flange 20 are formed in one single piece.

Each arched groove 22 has a general U-shape and has three successive portions:

a lower portion delimited by the lower bottom of the groove 22, substantially rectilinear;

an intermediate portion substantially in an arc of circle, having a curve oriented towards the front of the helmet; and an upper portion delimited by the upper bottom of the groove 22.

The lower and upper bottoms of the groove 22 are located substantially at the same distance from the oblong orifice 21, and these bottoms are the parts of the groove which are nearest to the oblong orifice 21.

In lowered position of the shield 3, each pin 33 is housed in the lower bottom of the corresponding groove 22 and the articulation axis 32 is housed in the back bottom of the oblong orifice 21. In lifted position of the shield 3, each pin 33 is housed in the upper bottom of the corresponding groove 22 and the articulation axis 32 is housed in the back bottom of the oblong orifice 21.

Between the lowered and lifted positions of the shield 3, each pin 33 circulates in the intermediate portion of the corresponding groove 22 and the articulation axis 32 is housed in the front bottom of the oblong orifice 21.

Thus, when the shield 3 is lifted starting from its lowered position and going to the lifted position, three phases can be observed:

in a first phase, each articulation axis 32 is displaced towards the front inside the oblong orifice 21 and concomitantly each pin 33 ascends in the lower portion of the groove 22, in such a manner that the shield 3 advances and is spaced apart from the shell 2 towards the front while beginning its ascension;

in a second phase, the articulation axis 32 is locked in the front bottom of the oblong orifice 21 and concomitantly each pin 33 ascends in the intermediate portion of the groove 22, in such a manner that the shield 3 pivots towards the top around articulation axes 32, while remaining spaced apart from the shell 2;

in a third phase, each articulation axis 32 is displaced towards the back inside the oblong orifice 21 and concomitantly each pin 33 ascends in the upper portion of the groove 22, in such a manner that the shield 3 gets nearer the shell 2 while ending the ascension thereof.

The lower and upper bottoms of the grooves 22 have reinforcements which form bearings guaranteeing a stable hold of the pins 33 inside these bottoms. The intermediate portion of each groove 22 is edged, on the back side, by a notched ridge which allows a displacement by bearing of the shield 3.

Each lateral arm 31 has a so-called follower element 34 which is in the form of a part protruding towards the bottom of a lower edge of the lateral arm 31. This follower element 34 is formed of one single piece with the lateral arm 31, but could have been produced independently and fixed on the lateral arm 31.

The chin guard 4 is moveable between two extreme positions, namely:

a so-called open position (visible on FIGS. 2, 5 and 12) in which the chin guard 4 is positioned on the back of the shell 2, beyond the top thereof;

a so-called closed position (visible on FIGS. 1, 9, 10, 14 and 15) in which the chin guard 4 is positioned on the front of the shell 2 and is positioned facing the chin of the wearer.

In a preferential manner, the chin guard 4 is provided with a locking system (not illustrated) on the shell 2 in the closed position.

The chin guard 4 has a central protective body 40 of curved shape, secured to two lateral branches 41 articulated on the shell 2, and particularly on the right and left lateral walls of the shell 2.

Figure 4:
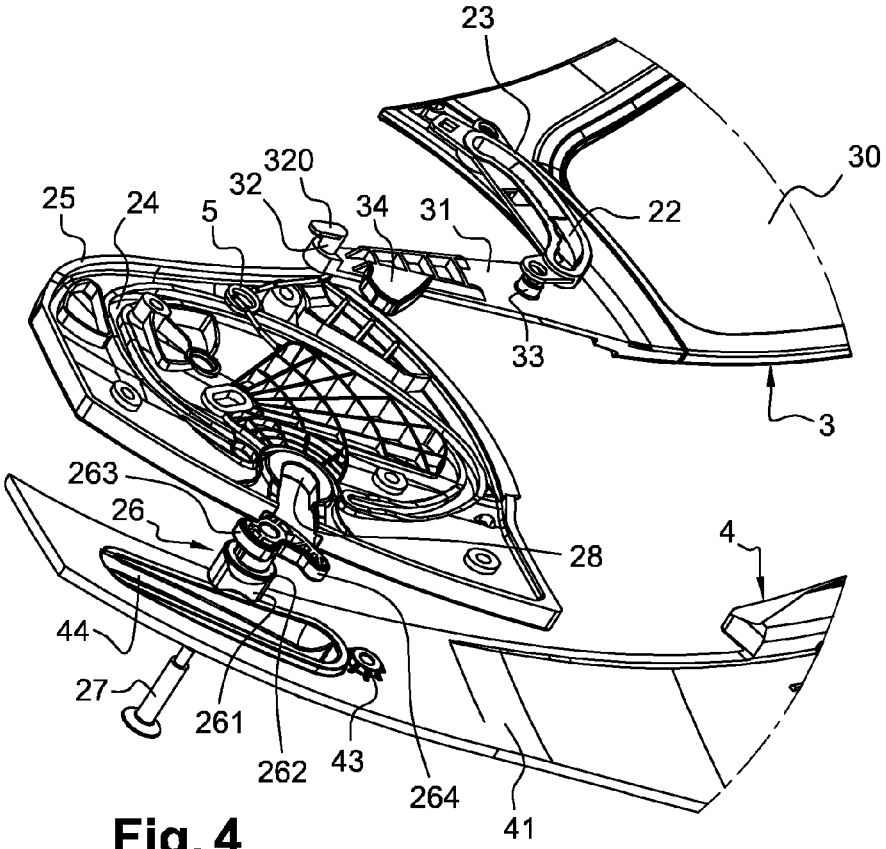
FIG. 4 is an exploded schematic and perspective view (internal side) illustrating the mounting elements of the shield and of the chin guard on the shell.

Each lateral branch 41 supports, on an inner face, a guiding pin 42 (visible on FIGS. 14 to 16), this guiding pin 14 being fixed in a housing provided on a stud 43 (visible on FIG. 4) arranged on the inner face of the lateral branch 41.

Each guiding pin 42 is slidably engaged in a slot 24 formed on a lateral wall or plate 25 secured to the shell 2. Each plate 25 covers the corresponding lateral arm 31 of the shield 3, as well as the flange 20. The slot 24 is through arranged on the concerned plate 25, and has a general curved shape and defines a guiding rail for the guiding pin 42. Reference is made to document EP 1 806 986 which describes such a groove in detail.

In a complementary manner, it is worth noting that these slots 24 define a complex trajectory of the chin guard 4 not entirely circular, combining rotation and translation, between its open and closed positions. Furthermore, contrary to the example of groove given in the document EP 1 806 986, each slot 24 has an entirely curved form, without a rectilinear portion and without an angle.

Each slot 24 has a substantially split ellipsoidal form, with mainly three successive portions:

a starting portion bordered by a starting bottom 241 in which the guiding pin 42 is positioned when the chin guard 4 is in closed position (see FIGS. 9, 10, 14 and 15), this starting portion defining a trajectory for spacing the chin guard with respect to the shell 2 towards the front during opening of the chin guard 4, with a pivoting mounting concomitant beginning of the chin guard 4;

an intermediate portion defining a trajectory for tipping the chin guard towards the back of the shell 2, by passing over the shield 3, with an inverting of the chin guard 4 between around 160 and 190° with respect to the closed position;

an arrival portion bordered by an arrival bottom 242 in which the guiding pin 42 is positioned when the chin guard 4 is in open position (see FIGS. 5 and 12), this arrival portion defining a trajectory for bringing the chin guard near against the back of the shell 2 with a pivoting descending concomitant ending of the chin guard 4.

In addition, each lateral branch 41 has a guide 44 produced in the form of a through oblong slit, and in which is slidably engaged a guiding finger 26 fixed on the shell 2. Thus, during the complex trajectory of the chin guard 4, the chin guard 4 slides along the guiding fingers 26 between its two extreme positions.

Each guiding finger 26 has a through hole in which is engaged a fixing stem 27, in particular by screwing, on the shell 2. Thus, each guiding finger 26 is pivotally mounted on the shell 2 along a transversal rotational axis defined by the stem 27.

Each guiding finger 26 has three portions:

an outer portion 261 of oblong form substantially complementary with the guide 44, this outer portion 261 being engaged inside the guide 44 in such a manner that the guiding finger 26 is rotationally linked with the lateral branch 41 of the chin guard 4, in other words the guiding finger 26 pivots along its transversal rotational axis concomitantly with the rotation of the chin guard 4;

an intermediate cylindrical portion 262, contracted with respect to the outer portion and provided to be engaged inside an oblong slit 28 arranged on an edge of the plate 25; and an inner portion 263 forming a cam, widened with respect to the intermediate portion 262 and having a protruding lug 264 radially spacing apart from the transversal rotational axis of the guiding finger 26.

In reference to FIGS. 14 and 16, the protruding lug 264 is curved and has a front concave surface 2641 (in other words domed towards the inside of the protruding lug 264), a dorsal convex surface (in other words domed towards the outside of the prosthesis) and a top 2643 joining the front and dorsal surfaces 2641, 2642.

In a situation, the outer portion 261 of the guiding finger 26 extends on the outer side of the plate 25 in order to collaborate with the guide 44, whereas the cam 263 extends on the inner side of the plate 25 in order to collaborate with the follower element 34 of the corresponding lateral arm 31 (as described later on); the intermediate portion 262 locking the guiding finger on the plate 25.

Thus, during the complex trajectory of the chin guard 4, the chin guard 4 slides along guiding fingers 26 between its two extreme position, and concomitantly, the guiding fingers 26 rotate around their respective rotational axes, thus causing the rotation of the cams 263, as illustrated on FIG. 13 which represents a tipping sequence of the chin guard from its open position (FIG. 13(*a*)) to its closed position (FIG. 13(*f*)) with the guiding pin 42 circulating in the slot 24.

In the closed position of the chin guard 4, and as visible on FIGS. 1, 9, 10, 11, 13(*f*), 14 and 15 the guiding finger 26 is angularly positioned in such a manner that the protruding lug 264 of the cam 263 is oriented towards the front of the helmet 1, and more specifically with its top 2643 oriented towards the front and lower part of the helmet 1 in a situation on the wearer. In this closed position, and as visible on FIGS. 14 and 15, the guiding pin 42 abuts against the convex dorsal surface 2642 of the protruding lug 264. Furthermore, in this closed position, the follower element 34 cannot come in contact with the cam 26, whatever the position of the shield 3; a hollow 2644 (referenced on FIG. 14) able to be provided on the cam 26, in the continuity of the convex dorsal surface 2642 of the protruding lug 264, in such a manner that the follower element 34 is not in contact with the cam 26 when the shield 3 is in lowered position.

In the open position of the chin guard 4, and as visible on FIGS. 2, 5, 12 and 13(*a*), the guiding finger 26 is angularly positioned in such a manner that the protruding lug 264 of the cam 263 is oriented towards the back of the helmet 1, and more specifically with its top 2643 oriented towards the back and top of the helmet 1 in a situation on the wearer. In this open position, and as visible on FIG. 13(*a*), the guiding pin 42 abuts against the convex dorsal surface 2642 of the protruding lug 264. Furthermore, in this open position, the follower element 34 abuts against the cam 26 and more specifically against the front concave surface 2641 of the protruding lug 264, when the shield 3 is in lowered position, such as visible on FIGS. 2 and 5. However, in this open position, the follower element 34 is not in contact with the cam 26 when the shield 3 is in lifted position, as visible on FIG. 12.

It is worth noting that the forms of the cam 26 and the follower element 34 are such that, when the chin guard 4 is in open or closed position, the shield 3 is free in movement between its lowered and lifted positions.

The two cam 26—follower element 34 assemblies, respectively on the right and on the left of the helmet 1, hence form cam-follower systems, where each cam 26 defines a cam surface (itself mainly defined by the surfaces 2641, 2642 and by the top 2643 of the protruding lug 264) for a contact with the follower element 34; these two cam-follower systems forming an automatic lifting mechanism of the shield 3 configured for partially lifting the shield 3 from its lowered position during the closing movement of the chin guard 4 passing from its open position to its closed position.

A closing sequence of the chin guard 4, with at the start a shield 3 in lowered position, is described hereinafter in reference to FIGS. 5 to 10:

in reference to FIG. 5, in a first configuration in which the chin guard 4 is in open position and the shield 3 is in lowered position, each guiding pin 42 is located on the arrival bottom 242 of the corresponding slot 24 and bears against the convex dorsal surface 2642 of the protruding lug 264 of the concerned cam 263, and each follower element 34 bears against the concave front surface 2641 of the concerned protruding lug 264;

in reference to FIG. 6, the chin guard 4 starts to tip towards the front (as schematized by arrow B) and concomitantly the shield 3 starts to lift automatically (as schematized by the arrow R), as each cam 26 has started to pivot (thanks to the guiding fingers 26 rotationally driven by collaboration with the guides 44) and each cam 26 acts on the corresponding follower element 34, thus making the lateral arms 31 and thereby the shield 3 pivot (pivoting of each lateral arm 31 around its articulation axis 32 with concomitant guiding of the pin 33 in the corresponding groove 22, and each follower element 34 is in contact with the concave front surface 2641 of the protruding lug 264 of the concerned cam 263, and at the same time each guiding pin 42 circulates in the slot 24;

in reference to FIG. 7, the chin guard 4 continues to tip towards the front (as schematized by the arrow B) and in a concomitant manner the shield 3 continues to lift automatically (as schematized by arrow R), until a partially lifted intermediate position of the shield 3 where each pin 33 is located at the end of the intermediate portion of the groove 22 and hence at the start of the upper portion of the groove 22 (each pin 22 still not housed in the upper bottom of the corresponding groove 22), and where each cam 26 is at the end of its contact with the corresponding follower element 34 (and more specifically each follower element 34 is in contact with the top 2643 of the protruding lug 264 of the concerned cam 263 in such a manner that once this contact with the top 2643 has been passed, the follower element 34 can no longer be pivotally driven by the cam 26);

in reference to FIG. 8, the shield 3 is urged towards the lifted position (as schematized by the arrow RE) thanks to elastic return members 5 which are mounted on the plates 25 and which act on the lateral arms 31, this final lifting movement of the shield 3 from the partially lifted intermediate position of FIG. 7 to the lifted position of FIG. 8 can only be carried out thanks to these elastic return members 5, the cams 26 no longer acting on the movement of the shield 3;

in reference to FIG. 9, the chin guard 4 has finished tipping towards the front and has passed over the shield 3 until reaching the closed position, the shield 3 remaining in its lifted position, and the cams 26 having broken contact with the corresponding follower elements 34;

in reference to FIG. 10, the shield 3 may be lowered (such as schematized by arrow A) until reaching its lowered position, with the chin guard 4 remaining in closed position, without however the cams 26 having to resume contact with the corresponding follower elements 34.

Each elastic return member 5 may come in the form of a helical spring having a branch fixed on the plate 26 (hence fixed on the shell 2) and another branch acting on the corresponding lateral arm 31. In a variant, each elastic return member 5 may come in the form of an elastically deformable blade or any other elastically deformable member acting on the corresponding lateral arm 31 in order to displace the shield 3 from the partially lifted intermediate position of FIG. 7 to the lifted position.

An opening sequence of the chin guard 4, with at the start a shield 3 in lowered position, is described hereinafter in reference to FIGS. 10 to 12:

in reference to FIG. 10, the shield 3 is in lowered position and the chin guard 4 is in closed position;

in reference to FIG. 11, the shield 3 is lifted (as schematized by the arrow RM) manually and automatically by means of a non illustrated complementary mechanism, and the chin guard 4 starts its opening movement (as schematized by the arrow OU) during which each guiding pin 42 breaks contact with the cam 26 before the cam 26 starts pivoting with the chin guard (in other words the chin guard 4 is mainly displaced along a translation movement, with possibly a few degrees of concomitant rotation, in such a manner that the guiding pins 42 have advanced in the slot 24 whereas the cam 26 has not pivoted or has only pivoted by a few degrees); in reference to FIG. 12, the chin guard 4 has finished tipping towards the back (as schematized by the arrow BR) until reaching its closed position.

Furthermore, as visible on FIG. 1, it is worth noting that when the shield 3 is in lowered position and the chin guard 4 in closed position, the shield 3 bears against an upper outer edge 46 of the chin guard 4, with particularly an inner face of the central visor 30 of the shield 3 bearing against a seal member 47 carried by the upper outer edge 46 of the chin guard 4.

Obviously, the aforementioned embodiment example has no limiting character and other improvements and details may be added to the helmet according to the invention, without however departing from the scope of the invention where other forms of cams and/or other forms of follower elements and/or more particularly other forms of cam surfaces may for example be produced.

The invention claimed is:

1. A protective helmet including a shell on which are moveably mounted a shield and a chin guard, the chin guard being moveable between a closed position at the front of the shell and an open position in which the chin guard is positioned at a back of the shell beyond a top of the shell, the chin guard having two lateral branches each provided with a guide in which is meshed at least one guiding finger fixed securely on the shell in such a manner that the chin guard slides along said guiding fingers between the two positions, and said shield being moveable between a lowered position and a lifted position and having two lateral arms articulated on the shell, wherein said helmet comprises an automatic lifting mechanism of the shield configured to lift at least partially the shield from the lowered position during a closing movement of the chin guard passing from the open position to the closed position, the automatic lifting mechanism of the shield including at least a cam-follower system comprising: a rotary cam secured to the at least one guiding finger, said at least one guiding finger being pivotally mounted on the shell along a transversal rotational axis and being connected in rotation to the corresponding lateral branch of the chin guard by cooperation of form with the guide thereof, and a follower element secured to a lateral arm of the shield, wherein the cam and the follower element are at least in partial contact along a given cam surface, and wherein the at least one cam follower system is configured in such a manner that, when starting from a first configuration in which the chin guard is in the open position and the shield is in the lowered position, when the cam automatically pivots as a result of the closing movement of the chin guard, the cam automatically drives the displacement of the shield by acting on the follower element in the direction of a lifting of the shield to a partially lifted intermediate position, and then the cam and the follower element break contact once the shield is in said intermediate position, whereas the cam continues to pivot until the chin guard reaches the closed position.

2. The helmet according to claim 1, wherein the lifting mechanism further includes at least an elastic return element urging the shield from the intermediate position to the lifted position.

3. The helmet according to claim 1, wherein each lateral arm of the shield supports, at a free end, an articulation axis slidably mounted in an oblong orifice provided on a wall secured to the shell.

4. The helmet according to claim 3, wherein each lateral arm of the shield supports a pin meshed in an arched groove mounted on the shell in order to impose a not entirely circular trajectory to the shield between the lowered and lifted positions.

5. The helmet according to claim 4, wherein the arched grooves are shaped in order to impose a trajectory combining translation and rotation in which during the lifting of the shield, starting from the lowered position, the shield first moves away from the shell towards the front, then follows a rotation movement, and finally draws closer to the shell to the lifted position.

6. The helmet according to claim 1, wherein each lateral branch of the chin guard supports, on an inner face, at least one guiding pin meshed in a slot formed on a lateral wall secured to the shell, said slot defining a trajectory of the chin guard which is not entirely circular, combining rotation and translation, between the open and closed positions.

7. The helmet according to claim 6, wherein the at least one guiding pin is in abutment against the at least one guiding finger when the chin guard is in the closed position.

8. The helmet according to claim 1, wherein the at least one guiding finger includes an outer portion of oblong form substantially complementary with the guide in which said at least one guiding finger is meshed.

9. The helmet according to claim 1, wherein the cam or each cam has a protruding lug radially spacing away from the transversal rotational axis of the corresponding guiding finger.

10. The helmet according to claim 1, wherein, when the shield is in lowered position and the chin guard in closed position, said shield bears against an upper outer edge of the chin guard, with an inner face of the shield bearing against a seal member held by the upper outer edge of the chin guard.

* * * * *